US006511758B1

(12) United States Patent
Kaitani

(10) Patent No.: US 6,511,758 B1
(45) Date of Patent: Jan. 28, 2003

(54) POROUS STRUCTURE BODY AND METHOD OF FORMING IT

(75) Inventor: Katsumi Kaitani, Osaka (JP)

(73) Assignee: Suitaya Co., Ltd., Osaka (JP)

( * ) Notice: Subject to any disclaimer, the term of this patent is extended or adjusted under 35 U.S.C. 154(b) by 0 days.

(21) Appl. No.: 09/763,799

(22) PCT Filed: Jun. 26, 2000

(86) PCT No.: PCT/JP00/04195

§ 371 (c)(1),
(2), (4) Date: Feb. 27, 2001

(87) PCT Pub. No.: WO01/02116

PCT Pub. Date: Jan. 11, 2001

(30) Foreign Application Priority Data

Jul. 5, 1999 (JP) ..... 11-189937
May 17, 2000 (JP) ..... 2000-144415

(51) Int. Cl.[7] ..... B32B 3/26; B32B 15/00; B22F 3/12; B22F 3/16; B22F 7/04

(52) U.S. Cl. ..... 428/550; 428/553; 428/564; 428/595; 428/650; 428/304.4; 419/31; 419/38

(58) Field of Search ..... 428/550, 595, 428/564, 553, 650, 304.4; 419/31, 38

(56) References Cited

U.S. PATENT DOCUMENTS 3,689,730 A * 9/1972 Campbell
4,205,420 A * 6/1980 Bothwell
4,357,393 A * 11/1982 Tsuda et al.
5,849,125 A * 12/1998 Clark
6,031,509 A * 2/2000 Kaitani

FOREIGN PATENT DOCUMENTS

JP 57-051231 * 3/1982

* cited by examiner

*Primary Examiner*—John J. Zimmerman
*Assistant Examiner*—Jason L Savage
(74) *Attorney, Agent, or Firm*—Darby & Darby

(57) ABSTRACT

A porous structural material having a solid shape with a curved surface of which the dimensional accuracy is high and the uses are wide is produced. The porous structural material is made form metallic chips containing at least one kind of ingredients, and comprises a solid-shaped body having a smooth and curved surface, the solid-shaped body being reformed by compacting a plate-shaped intermediate product in the hot state, the product being a molding with heating under a pressure while being highly electrified.

9 Claims, 4 Drawing Sheets

POROUS STRUCTURE BODY AND METHOD OF FORMING IT

TECHNICAL FIELD

The present invention relates to a porous structural materials having a solid shape with a curved surface of which the dimensional accuracy is high, and structural materials composed of plural layers and containing one or two metal sheets bonded metallurgically to the surface thereof. This invention also relates to process for forming the porous structural materials highly accurately.

TECHNICAL BACKGROUND

In general, metal sintered body having a flat plate shape has been produced by compacting metal powder as raw material under a high pressure and heating the compacted powder at a high temperature lower than the melting point according to powder metallurgy. In the conventional powder metallurgy, as the powdery raw materials, reduced iron powders made from iron ores and mill scales, electrolytic iron powders, atomizing powder and so forth are used. Produced metal sintered bodies are porous, having voids remaining therein. The voids are very fined and tight. Since the voids present in the metal sintered bodies are tight, the sintered bodies have no vibration- and sound-absorbing properties and also no gas permeability.

A method of molding a metal sintered body having large pores has been proposed in Japanese Patent Publication No. 58-52528. I am one of the inventors of the Japanese Patent Publication No. 58-52528. In this molding method, a porous sintered plate can be produced by pressing metal chips with heating while being electrified. The obtained sintered plate is superior in sound absorption, sound insulation and anti-vibration. The sintered plate is used in a variety of fields, as sound absorbers for concert halls and listening rooms, sound insulating plates for floor and wall boards in houses, and sound-proof and anti-vibration materials for vehicles and ships.

Moreover, I have filed Japanese Laid-open Publication No. 8-41508. In this patent specification, metal chips containing at least one kind of ingredients or such metal chips mixed with thermosetting resin or the like as raw material are pressed with heating while being electrified to produce a porous sintered plate. When the porous sintered plate thus obtained is used as a sound absorber, a sound insulator and a sound proof and anti-vibration material, the sound absorbing property, the sound insulation property, and the thermal insulation property can be enhanced. When the sintered plate is used as an electromagnetic shielding material, the conductivity can be enhanced. The molding apparatus disclosed in Japanese Laid-open Publication No. 8-41508 is the same as that of Japanese Patent No. 2,848,540, and also those shown in FIGS. 4 and 5 of U.S. Pat. No. 6,031,509.

The porous sintered plates produced as described in Japanese Patent Publication No. 58-5252and Japanese Laid-open Publication No. 8-41508 have excellent sound absorption and thermal insulation properties and a high conductivity as described above. However, the shapes of the obtained sintered plates are flat only. Furthermore, the sintered plates are slightly thicker in the centers thereof as compared with the peripheral portions thereof, and the surfaces of the sintered plates are slightly rugged. For this reason, to eliminate dispersions in thickness from the products, it is necessary to cut the surfaces of the sintered plates after the sintered plates are produced, so as to have a uniform thickness. That is, it is necessary to normalize the products. Moreover, if such a sintered plate is charged in a precision machine, it is also necessary to finish the surface of the sintered plate smoothly.

When the surfaces of the sintered plates are cut, the functions thereof such as the sound absorption and thermal insulation properties inherent in the sintered plates are deteriorated, caused by the reduction in thickness of the sintered plates. Moreover, voids exposed to the cut surfaces are different is shape and size, which causes dispersions in their performance as anti-vibration materials. That is, the normalization becomes unstable. Furthermore, the manufacturing costs of the sintered plates are remarkably increased, due to the additional cutting and finishing work.

Moreover, since the shapes of the sintered plates are flat only, uses of the sintered plates as anti-vibration materials and electromagnetic shielding materials have a limitation. Thus, the sintered plates are useless in effective anti-vibration or soundproof of apparatuses having an especial shape. That is, the sintered plates lack in general-purpose applicability. Even if such a flat plate-shaped sintered plate is cut to predetermined shapes and sizes, and the pieces are combined to be bonded, individually, so as to be applied in especial uses, the cost is so high that the practical application is impossible.

I have intensively investigated to solve the above-described problems of the porous sintered plates. As a result, it has been enabled to produce a high-functional porous structural material relatively easily.

Accordingly, it is an object of the present invention to provide a porous structural material having a solid shape with a curved surface, of which the general-purpose applicability is superior.

It is another object of the present invention to provide a porous structural material having a smooth surface and a high dimensional accuracy.

It is still another object of the present invention to provide a porous structural material having a high thermal insulation property and light in weight.

It is yet another object of the present invention to provide a process for forming a porous structural material comprising two steps, that is, molding and compacting.

It is still a further object of the present invention to provide a process for forming a structural material in which an intermediate molding product and a metallic sheet are metallurgically bonded, and simultaneously, the porous structural material is molded.

DISCLOSURE OF INVENTION

A porous structural material of the present invention is made from metallic chips containing at least one kind of ingredients. The structural material comprises a solid-shaped body having a smooth and curved surface, which is reformed by compacting a plate-shaped intermediate product in the hot state. The product is a molding with heating under a pressure while being highly electrified. In the structural material, pores on and near the surfaces are coarse and pores on the inside are dense in the direction of thickness.

A structural material of the present invention may be also composed of plural layers containing a metal sheet. The structural material comprises a body made from metallic chips containing at least one kind of ingredients and at least one metal sheet disposed on one or both sides thereof. The body is reformed by compacting an intermediate product and the metal sheet and bonded metallurgically to each other by heating while being electrified when compacting. The intermediate product is a molding with heating while being highly electrified. Preferably, in the structural material, the metal chips are shaved particles of aluminum-silicone alloy and the metal sheet is an aluminum sheet.

In a first forming process of the present invention, it is needed that metal chips containing at least one kind of ingredients are mixed, and charged into a molding frame at an approximately uniform level. An apparatus useful for forming is the same as the molding apparatus disclosed in Japanese Laid-open Publication No. 8-41508. The metal chips in the molding frame are compacted into a flat-plate shape with heating while being highly electrified. When the metal chips are mixed, glass particles, ferrite powder, cement powder and/or thermosetting resin in an amount of up to 25% by weight may be added. The metal chips are heated near the melting point when they are compacted. If the heating temperature is excessively low, the intermediate product is ready to be distorted. Thus, the dimensional accuracy of the finished product is deteriorated.

In the first forming process, the obtained intermediate product in the fevered state is removed, is set in a metal mold and compacted at a higher pressure than that applied in the reforming step. As a result, the intermediate product is reformed into a solid shape having a substantially uniform thickness and a curved surface. Then, the porous structural material as the finished product is removed from the metal mold. The intermediate product may be removed in the fevered state and cut to a required size and the respective cut pieces are charged in a mold to be compacted.

The temperature for compacting decreases from the heating temperature at compacting. However, preferably, the intermediate product is compacted in the hot state in which the internal temperature of the intermediate product is at least about 85 to 90% of the melting point of the metallic chips. For this reason, it is necessary immediately to set the intermediate product in a metal mold when the product in the fevered state is removed. If the internal temperature of the intermediate product is decreased to about 85% or less of the melting point of the metallic chips, it is difficult to reform the intermediate product into a solid shape of high dimensional accuracy.

Referring to a second forming process of the present invention, the metallic chips containing at least one kind of ingredients are mixed. An apparatus useful for the forming is the same as that disclosed in Japanese Laid-open Publication No. 8-41508. The metallic chips in a molding frame are compacted into a thin plate shape with heating under a pressure while being highly electrified. After cooling, at least one metal sheet is put on one or both sides of the intermediate product, set in a metal mold and reformed with heating under a pressure while being electrified by causing an electric current to flow across the upper and lower molds having a function as electrodes.

In the second forming process, the upper and lower molds may be a pair of rolls. The metal sheet put on one or both sides of the intermediate product is passed between a pair of the rolls to be re-pressed with heating while being electrified. Preferably, to obtain a solid shape, the metal sheet put on one or both sides of the intermediate product is re-pressed with heating while being electrified by causing an electric current to flow across the upper and lower molds.

BEST MODE FOR CARRYING OUT THE INVENTION

Figure 1:
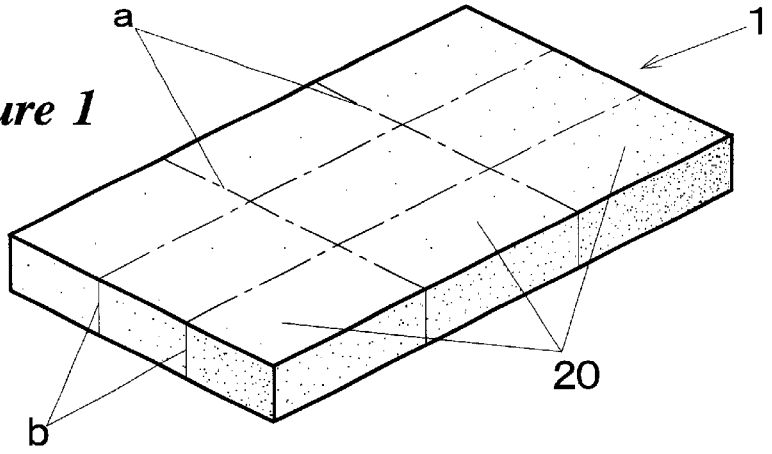
FIG. 1 is a schematic perspective view showing an example of the intermediate product.

For production of the porous structural materials of the present invention, metallic chips containing at least one kind of ingredients are used. The metallic chips are powder and shaved particles of metal or abatements or the like. Alloys containing two metal components may be used. As the metallic chips, iron type metals such as shaved particles of cast iron, carbon steel pieces or stainless steel pieces, aluminum type metals such as aluminum powder or shaved particles of aluminum-silicone alloy, copper type metals, titanium type metals such as titanium powder are exemplified. In general, the particle size of the metal chips to be employed is in the range of 6 to 50 meshes.

In the first forming process, to a mixture of the metallic chips, up to 25% by weight of glass particles, ferrite powder, cement powder and/or thermosetting resin may be added. The thermosetting resin may be mixed with other additives and then added. When the amount of the additive is up to about 10% by weight of the total weight of the structural material, the obtained structural material is sufficiently porous. If the amount is in the range of 10 to 25% by weight, the structural material has slightly reduced gas permeability, though the material has anti-vibration and sound absorption properties. On the other hand, in the second forming process, the metal chips are used without additives.

In the first and second processes of the present invention, for production of the intermediate product, the mixed metallic chips are charged in a molding frame having a quadrangular pipe shape as an apparatus for compacting. This apparatus is substantially the same as the molding apparatus disclosed in Japanese Laid-open Publication No. 8-41508. In this apparatus, a pair of rectangular electrode plates is mounted in opposition to each other on a horizontal ceramic plate, and a pair of rectangular heat-resistant side-walls are disposed perpendicularly to the electrode plates. A wire from a low voltage transformer is connected to one of the side-ends of one electrode plate and is connected to the opposite side end of the other electrode plate. The metallic chips are charged substantially uniformly into the molding frame. Then, the pressing die is lowered. The metallic chips are pressed to be compacted into a flat plate shape with heating by causing a high electric current at several thousands amperes to flow through the metallic chips.

For production of the intermediate product, a large electric current of which the maximum strength is 8000 amperes is allowed to flow through the metallic chips for heat-molding. Ordinarily, the voltage is up to 20 volts. In this case, even if the heating temperature in the molding frame reaches about 1000° C., the volume-diffusion scarcely occurs, attributed to the flow of the large electric current. Moreover, such phenomena as distortion of voids into spheres, reduction or absence of fine voids, and so forth are prevented. In the contact areas between the metallic chips, the metallic chips are partially and metallurgically bonded to each other. Even if the intermediate product contains a small amount of ceramics and synthetic resin in addition to the metallic chips, the sound absorbing property and the conductivity can be sufficiently kept even after compacting.

In the first forming process of the present invention, the intermediate product in the fevered state is removed from the compacting apparatus. The intermediate product as it is charged into a compacting mold, if the size of the finished product is large. In the case where the size of the finished product is smaller than that of the intermediate product, the intermediate product is cut to required sizes, and the respective pieces are charged into a reforming mold, respectively. For example, as shown in FIG. 1, the intermediate product is cut longitudinally and transversely to equal lengths along plural lines a and b. A plurality of pieces 20 are charged into a mold 18, respectively, and molded into a solid shape. The intermediate product may be longitudinally cut to form an elongated finished product. The intermediate product may be transversely cut to obtain a thinner finished product.

The intermediate product in the fevered state is compacted into a solid shape having a curved surface. Generally, compacting molds are not provided with heaters. Thus, the temperature of the intermediate product is reduced from the heating temperature at compacting. When the intermediate product is compacted in the mold, preferably, the internal temperature of the intermediate product is at least about 85 to 90% of the melting point of the metallic chips. If the solid shape of the finished product is complicate and has deep concavities and high convexities or the like, the internal temperature of the intermediate product needs to be higher.

When a porous structural material 21 (FIG. 2) as the finished product is removed from a mold 18, the porous structural material 21 is cooled while heat is dissipated into the inner side of the sintered body. The inner structure of the porous structural material will be described in reference to FIG. 3. Generally, pores on and the surface 22 are coarse, and pores on the inside 23 are dense in the direction of thickness. The surface of the porous structural material is smooth with substantially no convexities and concavities. Voids at the surface are substantially uniform. The size of the voids of the porous structural material can be controlled with the heating temperature by electrification, pressing force and time, and a mix ratio of different types of metallic chips. Moreover, pores at the surface can be made coarser, and pores on the inside can be made denser by changing the shape and size in thickness direction of the metallic chips.

Figure 4:
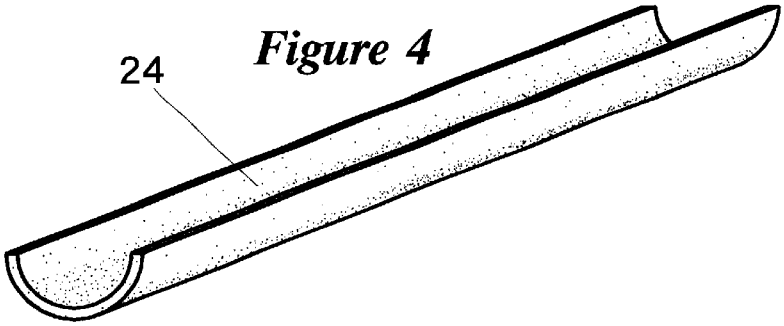
FIG. 4 is a schematic perspective view showing a porous structural body of the present invention.
Figure 5:
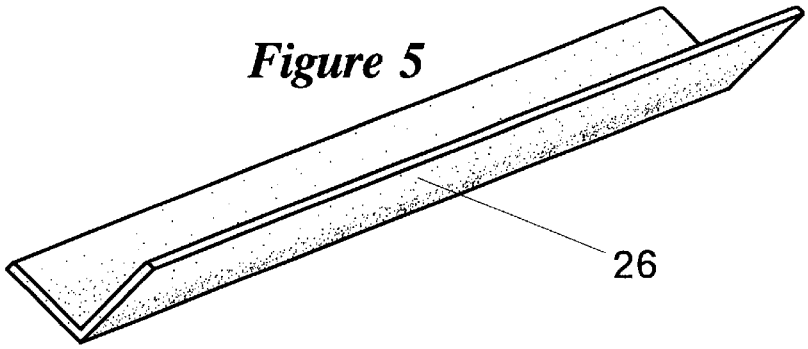
FIGS. 5 to 9 are schematic perspective views showing porous structural bodies having the other shapes, respectively.
Figure 6:
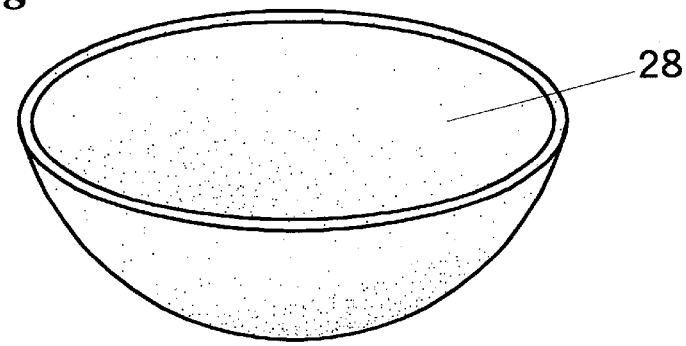

The porous structural material thus obtained has a solid shape with a curved surface as shown in FIGS. 4 to 6. For example, as shown in FIG. 4, sheet materials 24 each having a semi-circular cross section are formed of an elongated intermediate product. Two of the sheet materials are butted to each other sp as to form a cylinder. A high voltage wire or the like is inserted into the cylinder. Thus, the cylinder is used as an electromagnetic shielding material. As shown in FIG. 5, an elongated intermediate product is formed into a sheet material 26 having a V-shaped cross section. Similarly, porous structural materials having a U-, L-, W- or C-shaped cross section or other cross section are produced and can be used for various kinds of anti-vibration materials and sound absorption materials. Moreover, as shown in FIG. 6, a thin intermediate product is cut into a circular shape, and is formed into a cup-shaped material 28 having a semi-circular central cross-section. Similarly, porous structural materials with central cross sections having shapes such as an inverse circular cone, an inverse truncated pyramid, an inverse circular truncated cone, and so forth can be produced, and can be used in such a manner that noise sources or vibration sources are put into the porous structural materials, or are covered with the porous structural materials.

Figure 7:
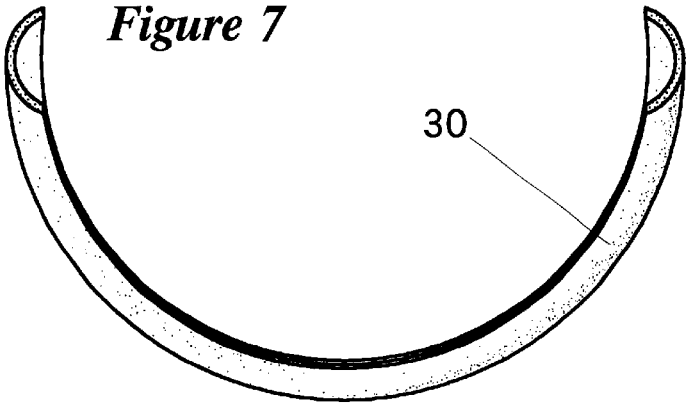
Figure 8:
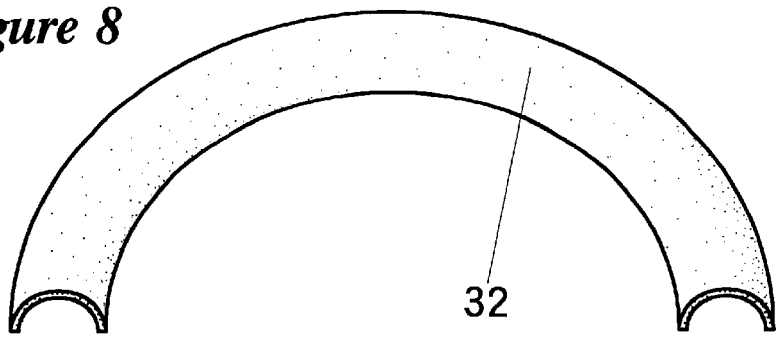
Figure 9:
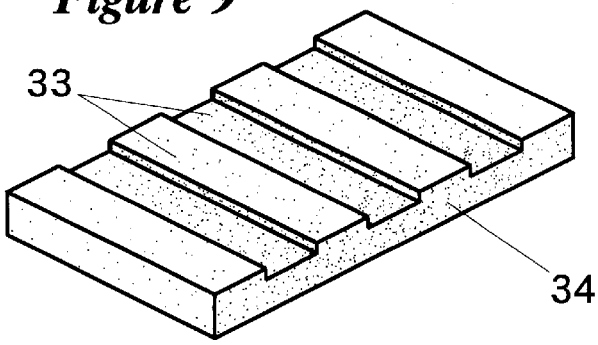

The porous structural material may be reformed so as to have a relatively especial shape as shown in FIGS. 7 to 9. For example, as shown in FIG. 7, the longitudinal side-face of an elongated intermediate product is bent into a semi-circular shape, and moreover, the transverse side-face is formed into a semi-circular shape. As shown in FIG. 8, the flat surface of an elongated intermediate product 1 is bent into a semi-circular shape, and moreover, the transverse side face is formed into a semi-circular shape. Porous structural materials 30 and 32 shown in FIGS. 7 and 8 can be fixed so as to cover a rolling bearing which is a noise source of a machine. FIG. 9 shows a flat plate-shaped porous sintering body 34 having shallow concavities and convexities 33 formed at the surface thereof. The porous sintering body 34 can be produced from a flat plate-shaped compacting-product. Similarly, a rugged surface pattern can be formed.

In the second forming process of the present invention, an intermediate product similar to that in the first forming process is used. However, the intermediate product is cooled after molding. The intermediate product has a thin plate shape and is generally thinner and has a larger flat plane area as compared with the intermediate product in the first process. The metal sheet used in this process may be appropriately selected, depending on uses. Aluminum sheets, copper sheets or stainless steel sheets are exemplified.

Figure 10:
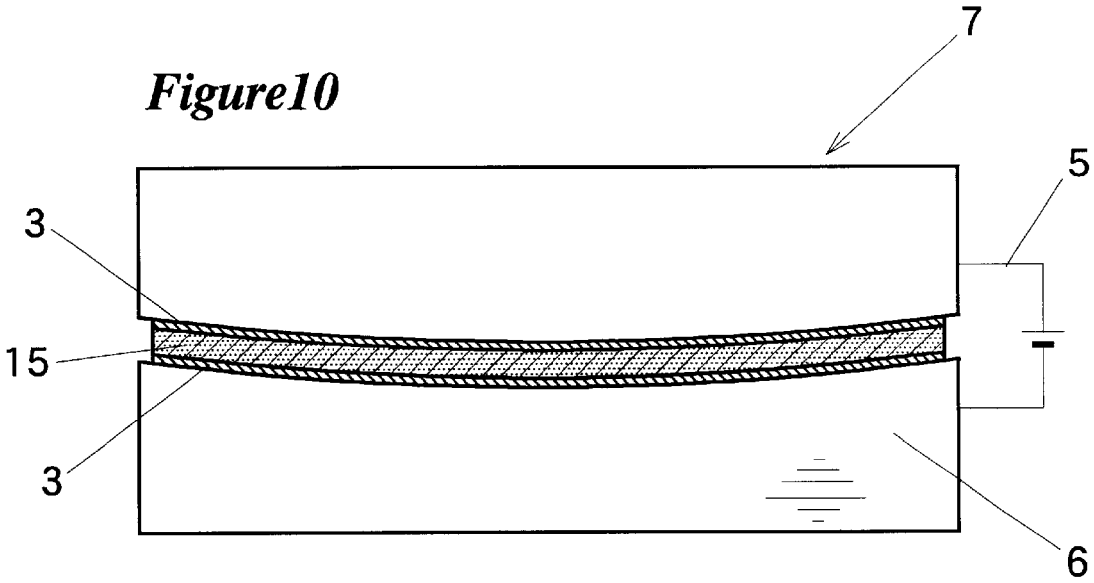
FIG. 10 is a schematic sectional view showing a modification of the compacting mold.
Figure 12:
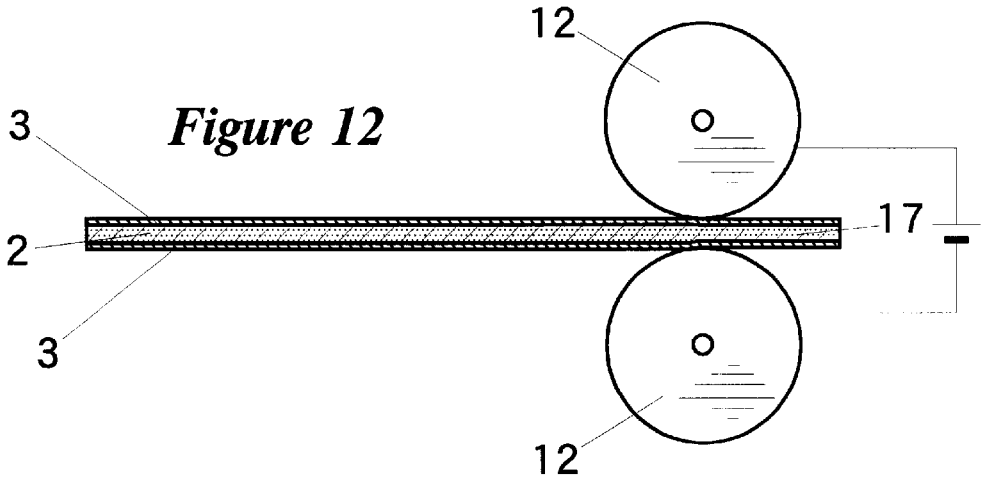
FIG. 12 is a schematic side view showing a pair of rolls for compacting.

In the second process, metal sheets 3 and 3 are put on one or both sides of an intermediate product 2 (see FIG. 12) after cooling. They are set in a metal mold 7 and re-pressed with heating while being electrified by causing an electric current to flow across the upper and lower molds 5 and 6 having a function as electrodes. Regarding the metal mold, the pressing inner surfaces of the upper and lower molds may be flat or be slightly curved as shown in FIG. 10. Instead of the metal mold, a pair of rolls 12 and 12 having a function as electrodes may be used. As shown in FIG. 12, the metal sheets 3, 3 may be put on the intermediate product 2 and passed between a pair of the rolls 12 and 12. To obtain a solid shape having a curved surface, the intermediate product and the sheets 3, 3 are re-pressed with heating while being electrified by means of the upper and lower molds 5 and 6, as typically shown in FIG. 10.

Figure 11:
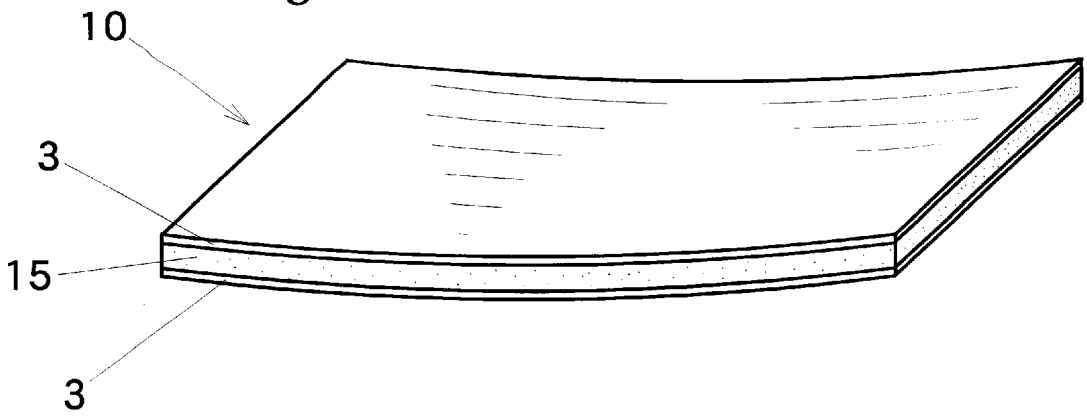
FIG. 11 is a schematic perspective view showing another modification of the structural material.
Figure 13:
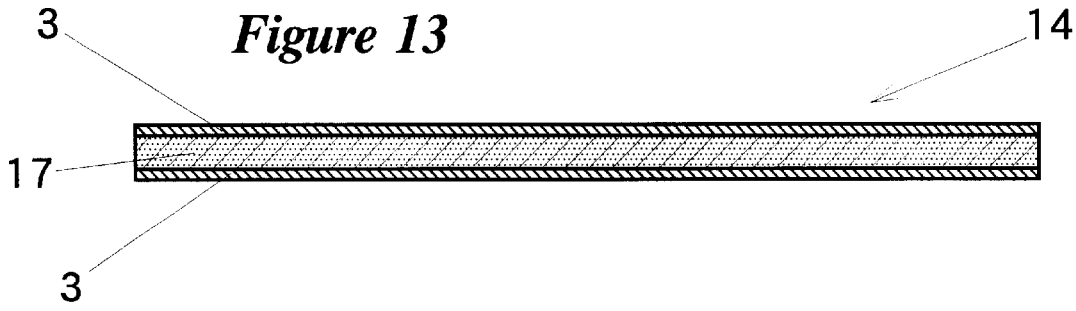
FIG. 13 is a schematic perspective view showing a it further modification of the structural material.

The product 15 (see FIG. 10) and the metal sheets 3, 3 are metallurgically bonded to each other by pressing with heating while being electrified. The structural materials 10 and 14 thus obtained with plural layers may have a solid shape with a slightly curved surface as shown in FIG. 11, or may be flat as shown in FIG. 13. Regarding the solid shape having a curved surface, the surface has a semi-circular shape, a U-, V- or L-shape having a small height, a shallow cup shape or the like. Thus, the intermediate product put upon the metal sheets can be compacted into an uneven shape correspondingly to uses.

The structural materials 10 and 14 each have a high strength, high anti-vibration and thermal insulation properties. Thus, the structural materials 10 and 14 can be applied for uses requiring both of high strength and anti-vibration property. For example, the materials 10 and 14 can be used for the bodies, chassis and engine covers of motorcars to contribute to reduction in weight of the motorcars and noise reduction thereof. The flat structural material 14 may be worked so as to have a circular, flat plane, and can be used as an anti-vibration washer.

Hereinafter, the present invention will be described with reference to the following examples, however, it will be understood that the present invention is not limited by the following examples.

EXAMPLE 1

As metallic chips, there was used 5 kg of shaved particles or abatements of cast iron (FC-25) containing about 3.5% carbon, about 2.5% silicon and about 0.5% manganese. When compacting with a primary molding apparatus, a separation sheet was flatly planed on the bottom surface of the molding frame. The metal chips were put on the separation sheet, and leveled on the surface thereof so as to be about 15 mm in thickness. Moreover, a separation sheet was flatly placed thereon.

Next, a ceramic pressing die was lowered, and simultaneously, the electric power was turned on. Now, the metallic chips were pressed at an electric voltage of 20 volts by lowering the pressing die. When the pressurization was continued at a pressure of 10 kg/cm$^2$, the electric current flowing through the molding frame increased to 6000 amperes, and the chips were heated to about 1100° C. After pressing for 3 minutes with the pressing die, the die was lifted, and the intermediate product 1 (FIG. 1) was removed.

Figure 2:
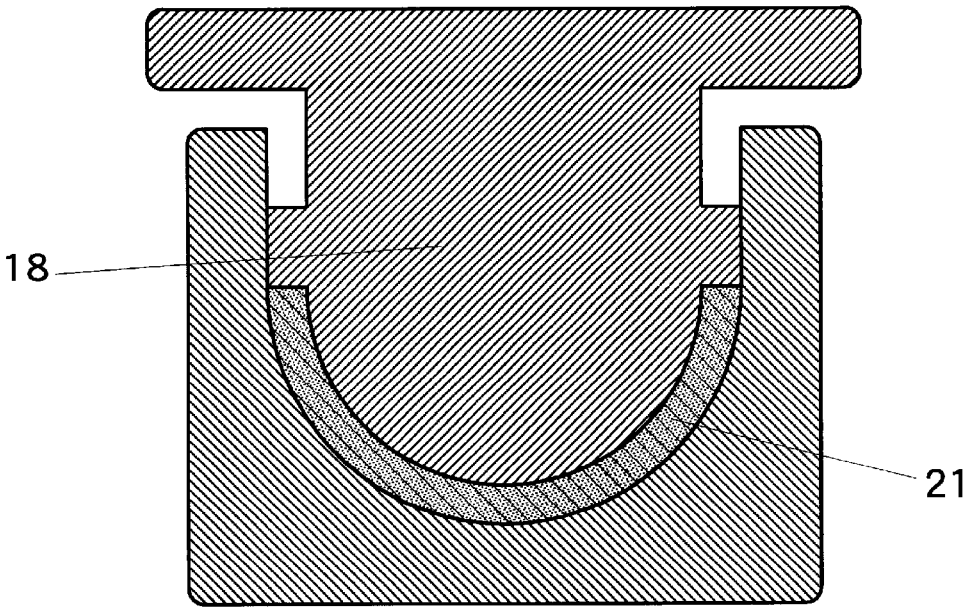
FIG. 2 is a schematic sectional view showing an example of a compacting mold used in the invention.
Figure 3:
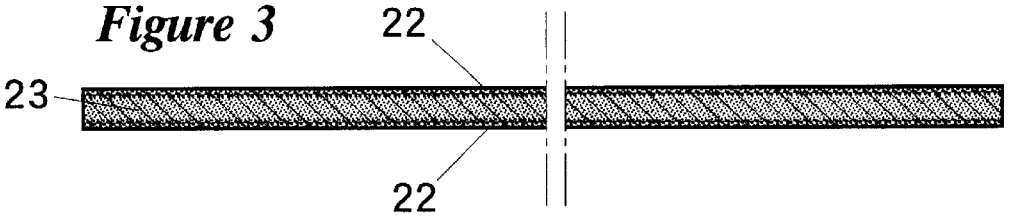
FIG. 3 is a partially enlarged sectional view showing the internal structure of a porous structural material.

The intermediate product thus obtained had a flat plate shape and a size of 370×670×5 mm. The intermediate product in its fevered state was removed from the primary forming apparatus. The intermediate product was longitudinally cut to equal lengths along straight lines b in FIG. 1 to form 3 pieces. Moreover, the pieces were horizontally cut to equal lengths. The thin pieces 20 in the fevered state were set in a compacting or secondary mold 18 (FIG. 2).

The respective thin pieces in a secondary mold 18 at a pressure of 100 to 120 kg/cm$^2$, so that a porous structural body 4 (FIG. 4) having a semi-circular cross section was formed. In the direction of thickness of the porous structural body 24, pores on and near the surface were coarse, and pores on the inside were dense. The surface was smooth, and voids at the surface were substantially uniform.

EXAMPLE 2

In the primary molding apparatus, after a separation sheet was placed on the bottom surface of the molding frame, 6 kg of shaved particles or abatements of aluminum-silicone alloy containing 20% silicone was charged and leveled so as to be about 50 mm in thickness. Further, a separation sheet was flatly placed on the surface of the shaved particles.

Next, a pressing die was lowered, and simultaneously, the electric power was turned on. Now, the metal chips were pressed at an electric voltage of 20 volts. The pressurization was continued at a pressure of 10 kg/cm$^2$. After pressing for about 3 minutes, the current strength reached the equilibrium at 4500 to 5000 amperes. Then, the pressing die was lifted, and the intermediate product 1 was removed.

The obtained intermediate product 1 in its fevered state, having a flat plate shape, was removed from the primary molding apparatus. The intermediate product 1 was longitudinally cut to equal lengths along the straight line b shown in FIG. 1 to form 3 pieces. Moreover, the pieces were horizontally cut to equal lengths. The thin pieces 20 in the fevered state were charged in the secondary mold before the surface temperature decreased to about 950° C., respectively.

The respective thin pieces were pressed at a pressure of 100 to 120 kg/cm$^2$ in the secondary mold to form a porous structural body 26 (FIG. 5) having a V-character shaped cross section. In the porous structural body 26, pores on and near the surfaces were coarse, and pores on the inside were dense in the direction of thickness. The surface was smooth, and voids at the surface were substantially uniform.

EXAMPLE 3

12 kg of the same the shaved particles of cast iron containing about 3.5% carbon as used in Example 1 was mixed with 5 kg of the shaved particles of common steel containing 0.5% carbon (manufactured by Sin-Nippon Steel Corporation). Thus, metal chips comprising the shaved particles of the cast iron and those of the carbon steel were obtained. In the primary molding apparatus, after a separation sheet was placed on the bottom surface of the molding frame, 17 kg of the particles comprising the cast iron shave particles and the common steel shaved particles were charged and leveled so as to be about 50 mm in thickness. Further, a separation sheet was flatly placed on the surface of the particles.

Next, the pressing die was lowered, and simultaneously, the electric power was turned on. The particles were pressed at a voltage of 20 volts by lowering the pressing die. Then, the carburizing phenomena occurred, in which the carbon contained in the shaved particles of the cast iron were migrated into the surface of the shaved particles of the carbon steel in the contact area between both of the shaved particles. Accordingly, the size of voids in the obtained sintered plate could be controlled by changing the mixing ratio of the shaved particles of the cast iron to those of the steel iron.

The obtained intermediate product 1 had a flat plate shape, and was removed in the fevered state from the primary molding apparatus.

The intermediate product 1 was cut longitudinally and horizontally to equal lengths along the straight lines a and b shown in FIG. 1 to form 9 pieces 20. The pieces 20 in the fevered state were charged in the secondary mold before the surface temperature decreased to about 950° C., respectively.

The respective pieces 20 were pressed at a pressure of 100 to 120 kg/cm$^2$ in the secondary mold to form a porous structural material 24 (FIG. 4) having a V-character shaped cross section. In the porous structural material, pores on and near the surface were coarse, and pores on the inside were dense in the direction of thickness. The surfaces were smooth, and voids at the surface were substantially uniform.

EXAMPLE 4

15 kg of the same shaved particles or abatements of the cast iron as used in Example 1 was mixed with 3 kg of glass particles with an average diameter of 1 mm to obtain metallic chips. A thin paperboard was placed on the bottom surface of the molding frame of the primary molding apparatus. Water was sprayed on the surface of the paperboard. Succeedingly, 12 kg of the above-described particles was uniformly charged on the paper board. Further, a thin paper board onto which water was sprayed was placed thereon.

Next, the pressing die was lowered, and simultaneously, the electric power was turned on. After pressing for 1 to 2 minutes, the temperature in the molding frame reached 850 to 1000° C. When the temperature became 1000° C., the current was stopped, and the intermediate product 1 was removed.

The obtained intermediate product 1 in its fevered state, having a flat plate shape, was removed from the primary mold. For example, the intermediate product 1 was cut longitudinally and horizontally to equal lengths along the straight lines a and b shown in FIG. 1 to form 9 pieces 20. The pieces 20 in the fevered state were charged in the secondary mold before the surface temperature decreased, respectively.

The respective pieces 20 were pressed at a pressure of 60 to 80 kg/cm$^2$ for 1 minute in the secondary mold to form a cup-shaped, glass-containing porous structural body 28 (FIG. 6). The porous structural body 28, after it was removed from the secondary mold, was put in a hot tank in order to prevent from being rapidly cooled, and was gradually cooled to the room temperature. The porous structural body 28 was sufficiently porous and had a conductivity. The specific gravity was 2.7 to 3.0. Electric current could be satisfactorily flown between both ends of the porous structural body 28. When the amount of the glass particles reached about 25% of the overall weight in a glass board made of the porous structural body, the board had substantially no gas permeability though it was conductive.

EXAMPLE 5

As the metallic chips, shaved particles or abatements of aluminum-silicone alloy containing 30% silicone were used. In the case where the metallic chips were sintered in a large primary molding apparatus, a separation sheet was flatly placed on the bottom surface of the molding frame. The metal chips were charged thereon. The surface was leveled so as to be about 9 mm in thickness. Further a separation sheet was flatly placed thereon.

Next, the pressing die was lowered, and simultaneously, the electric power was turned on. The chips were pressed at a voltage of 20 volts by lowering the pressing die. The pressurization was kept at a pressure of 10 kg/cm$^2$. After pressing for about 3 minutes, the current strength reached the equilibrium at 4500 to 5000 amperes. Then, the pressing die was lifted, and the intermediate product (FIG. 11) was removed.

The obtained intermediate product was a thin plate, and had a size of 600×600×3 mm. The intermediate product was removed from the primary molding apparatus, and was spontaneously cooled. After cooling, aluminum sheets 3, 3 with a thickness of 1 mm were put on both sides of the intermediate product, and charged into the compacting mold 7 of which the upper and lower molds 5 and 6 had slightly curved pressing inner surfaces. The upper and lower molds also function as electrodes. The intermediate product can be gradually pressed while it is heated while being electrified by causing an electric current at about 20 volts to flow across the upper and lower molds.

The intermediate put upon the aluminum sheets 3 and 3 were pressed for one minute at a pressure of about 50 kg/cm$^2$ in the secondary mold. The obtained porous structural body 10 (FIG. 11) had shallow U-shaped side faces.

As regards the porous structural body 10, the aluminum-silicone alloy as the material have an attenuation coefficient ($\eta$) of 0.00004 to 0.00006. The finished product had a high rigidity, that is, the attenuation coefficient was 0.02 to 0.09. The porous structural body 10 bonded metallurgically to the aluminum sheets 3 and 3 had an attenuation coefficient ($\eta$) of 0.01 to 0.09. The attenuation time was very short. The porous structural material 10 had high strength and anti-vibration property, and also, was light in weight. Thus, the porous structural body 10 can be used for the bodies and chassis of motorcars by compacting the porous structural body 10 so as to have an appropriate curved surface.

EXAMPLE 6

Referring to FIG. 12, the same intermediate product 2 as obtained in Example 5 was used. On both sides of the intermediate product 2 after cooling, aluminum sheets 3 and 3 with a thickness of 1 mm were put, and were passed between and through a pair of rolls 12 and 12 (FIG. 12). The rolls 12 and 12 also function as electrodes. The metal sheets 3 and 3 put on the intermediate product 2 can be pressed with heating while being electrified by causing an electric current at a voltage of about 20 V to flow across both of the rolls.

The aluminum sheets 3 and 3 put on the intermediate product 2 was pressed at a pressure of about 50 kg/cm$^2$ between a pair of the rolls 12 and 12 (FIG. 12), whereby the finished molding product 17 and the aluminum sheets 3 and 3 were metallurgically bonded to each other. The obtained porous structural material 14 (FIG. 13) was flat, and had a very short attenuation time, that is, the attenuation coefficient ($\eta$) was in the range of 0.01 to 0.09. The porous structural body 14, having high anti-vibration and thermal insulation properties, can be used as an anti-vibration washer by cutting the porous structural material into a circular shape with an appropriate diameter.

INDUSTRIAL APPLICABILITY

A porous structural body of the present invention has a smooth surface, a uniform thickness and high dimensional accuracy. Cost to manufacture the body is reduced, since surface cutting or finishing is not required after the manufacture. When the porous structural body is used as an anti-vibration material, which is superior to a rubber anti-vibration material in the view points of absorption limits, deterioration of qualities, and use in a high temperature environment. Moreover, the porous structural material can be marketed substantially at the same price as that of the rubber ant-vibration material.

The porous structural material of the present invention can be reformed into a variety of solid shapes including curved surfaces and can partially reduce the vibration or noises of an apparatus generating noises. If the porous structural material is used as soundproof and anti-vibration material, sound absorbing or insulating materials, the sound absorption, sound insulation and thermal insulation properties can be enhanced. When the porous structural material is used as an electromagnetic shielding material, the conductivity can be enhanced, by adjusting the size of voids and the thickness of layers.

Also, in the case where the structural material is composed of plural layers having at least one metal sheet, the strength is high and the anti-vibration and thermal insulation properties are excellent. The structural material can be used for the bodies, chassis and engine covers of motorcars having curved surfaces and can be used for anti-vibration washers having a circular flat surface.

According to a process of the present invention, the porous structural material having a high dimensional accuracy can be formed from metallic chips containing at least one of ingredients, with a high stability. Thus, the standardized products as industrial products can be obtained. Moreover, in the process of the present invention, when the structural material having a solid shape including a curved surface, no partial distortion occurs in contrast to a simple secondary working, and the problems that cracks and fractures are formed at heating and pressing can be solved.

What is claimed is:

1. A structural material with plural layers comprising:

a porous body comprising metallic chips, wherein the body has a smooth surface and a curve, in which the pores on and near the surface are coarse and pores on the inside of the body are dense in the direction of thickness; and at least one metal sheet disposed on the surface of the body, wherein the structural material is formed by bonding a metal sheet to an intermediate product by heating under electric current, in which the intermediate product is a molding formed with heating under pressure and electric current.

2. A structural material of claim 1, wherein the metallic chips are shaved particles of aluminum-silicon alloy, and the metal sheet is an aluminum sheet.

3. A process for forming a porous structural material, which comprises:

mixing metallic chips with or without an additive to form a mixture and charging the mixture into a molding frame at an approximately flat level;

molding the mixture in the molding frame into a flat-plate shape with heating near the melting point of the metallic chips under pressure and electric current to form an intermediate product;

removing the intermediate product in its fevered state;

setting the intermediate product in a metal mold;

compacting the intermediate product under a higher pressure than is applied in the molding step to form a body having a smooth surface and a curve, in which the pores on and near the surface are coarse and pores on the inside of the body are dense in the direction of thickness; and removing the body from the metal mold.

4. A process according to claim 3, wherein an additive in an amount of up to 25% by weight of the total amount of the metallic chips and additive is added, wherein the additive is selected from the group consisting of glass particles, ferrite powder, cement powder, and thermosetting resin.

5. The process according to claim 3, wherein the intermediate product removed in its fevered state is cut into pieces, and the pieces are put into the metal mold and are compacted.

6. The process according to claim 3, wherein the internal temperature of the intermediate product when compacted is at least about 85 to 90% of the melting point of the metallic chips.

7. A process for forming a structural material with plural layers, which comprises:

mixing metallic chips with or without an additive to form a mixture and charging the mixture into a molding frame;

molding the mixture in the molding frame into a flat-plate shape with heating under pressure and electric current to form an intermediate product;

putting at least one metal sheet on a surface of the intermediate product;

setting the intermediate product and the metal sheet in a metal mold;

compacting the intermediate product and the metal sheet into a solid shape with heating under pressure and electrical current, wherein the pressure is a higher pressure than that applied in the molding step and wherein the electrical current flows across an upper mold and a lower mold in which the molds function as electrodes, to form the structural material having a curve; and removing the structural material from the mold.

8. A process according to claim 7, wherein the upper mold and the lower mold are composed of a pair of rolls and the intermediate product and the metal sheet are passed between the pair of rolls when compacted with heating under electrical current.

9. A process according to claim 7, wherein the upper mold and the lower mold each have a cavity with a moderate curved surface and the intermediate sheet and the metal sheet are compacted to form a structural material having a curve.

* * * * *